US011517804B2

(12) United States Patent
Harrison et al.

(10) Patent No.: US 11,517,804 B2
(45) Date of Patent: Dec. 6, 2022

(54) METHOD AND APPARATUS FOR FALSE START DETECTION

(71) Applicant: UNIVERSITY OF LIMERICK, Limerick (IE)

(72) Inventors: Andrew Harrison, Limerick (IE); Thomas Barr, Limerick (IE); Kevin Hayes, Limerick (IE)

(73) Assignee: UNIVERSITY OF LIMERICK, Limerick (IE)

( * ) Notice: Subject to any disclaimer, the term of this patent is extended or adjusted under 35 U.S.C. 154(b) by 243 days.

(21) Appl. No.: 16/635,945

(22) PCT Filed: Jul. 27, 2018

(86) PCT No.: PCT/EP2018/070449

§ 371 (c)(1),
(2) Date: Jan. 31, 2020

(87) PCT Pub. No.: WO2019/025313

PCT Pub. Date: Feb. 7, 2019

(65) Prior Publication Data

US 2021/0138333 A1 May 13, 2021

(30) Foreign Application Priority Data

Aug. 1, 2017 (GB) ..... 1712371

(51) Int. Cl.
*A63B 71/06* (2006.01)
*A63B 69/00* (2006.01)
*A63K 3/02* (2006.01)

(52) U.S. Cl.
CPC ..... *A63B 71/0605* (2013.01); *A63B 69/0028* (2013.01); *A63K 3/023* (2013.01);
(Continued)

(58) Field of Classification Search
CPC ..... A63B 71/0605; A63B 69/0028; A63B 2220/51; A63B 2220/62; A63B 2220/833; A63K 3/023
See application file for complete search history.

(56) References Cited

U.S. PATENT DOCUMENTS 2,165,749 A * 7/1939 Engholm ..... G04F 8/08 968/843
4,194,101 A * 3/1980 Berseth ..... A63B 71/0605 200/86.5

(Continued)

FOREIGN PATENT DOCUMENTS

DE 202009010285 U 2/2010
EP 2457623 A1 5/2012

(Continued)

OTHER PUBLICATIONS

Machine translation to JPH01221183A.*

(Continued)

*Primary Examiner* — Malina D. Blaise
(74) *Attorney, Agent, or Firm* — Lathrop GPM LLP

(57) ABSTRACT

A method, a false start detection system, and a false start detection sensor for determining whether an athlete has performed a false start in an event. Force data is received representing the force exerted by at least one upper appendage of the athlete on a surface when in a starting position (S701). The force data is processed to determine an athlete start time (S702), and the athlete start time is compared to an event start time to determine whether a false start has occurred (S703).

7 Claims, 6 Drawing Sheets

(52) U.S. Cl.
CPC ..... *A63B 2220/51* (2013.01); *A63B 2220/62* (2013.01); *A63B 2220/833* (2013.01)

(56) References Cited

U.S. PATENT DOCUMENTS

| | | | | |
|---|---|---|---|---|
| 5,467,652 | A * | 11/1995 | Richards | A63K 3/023 482/8 |
| 6,002,336 | A * | 12/1999 | Widding | A63B 71/0605 482/8 |
| 6,494,812 | B1 * | 12/2002 | Grimes, Jr. | A63K 3/023 482/14 |
| 8,992,386 | B2 * | 3/2015 | Zanetta | A63K 3/02 482/14 |
| 2012/0192346 | A1 * | 8/2012 | Maas | A63K 3/023 4/496 |
| 2012/0316036 | A1 * | 12/2012 | Zanetta | A63K 3/02 482/8 |
| 2017/0065871 | A1 * | 3/2017 | Galli | A63B 24/0062 |
| 2017/0071813 | A1 * | 3/2017 | Sugata | A63B 22/0242 |
| 2018/0001139 | A1 * | 1/2018 | Moyerman | G01R 33/02 |
| 2021/0138333 | A1 * | 5/2021 | Harrison | A63B 69/0028 |

FOREIGN PATENT DOCUMENTS

| | | | |
|---|---|---|---|
| JP | S6244282 | A | 2/1987 |
| JP | H01221183 | A | 9/1989 |
| JP | 2001204872 | A | 7/2001 |
| KR | 101135988 | B1 | 4/2012 |
| WO | WO 2016094314 | A1 | 6/2016 |

OTHER PUBLICATIONS

PCT/EP2018/070449 International Search Report and Written Opinion dated Oct. 30, 2018, 15 pages.
GB Patent Application No. 1712371.2 Search Report dated Jan. 3, 2018, 5 pages.

* cited by examiner

METHOD AND APPARATUS FOR FALSE START DETECTION

The present invention is directed towards a method for determining whether an athlete has performed a false start in an event, a false start detection system, and a false start detection sensor.

In many events, athletes are required to propel themselves from a stationary position to a finish line in the shortest time possible. For example, in foot races athletes will start from a position crouched in a starting block, and then perform a starting action where they push off from the starting block to begin the race. All of the athletes are required to start the event at a fixed instant in time, which is typically indicated by a starting signal. The starting signal is an audible sound such as a bleep, or gun sound.

In order to ensure fairness, it is desirable to identify any athletes who perform a false start. A false start is signified by the athlete beginning a starting action before the event start time or within a fixed margin after the event start time. The event start time is indicated by the issuance of the starting signal.

Traditionally, false starts have been identified by event officials visually observing the athletes. This approach is prone to error. Automated systems have been developed which incorporate sensors into the starting blocks used in some foot races. These sensors detect the force of the feet of the athlete on the starting blocks, and analyse the shape of the force curve to detect a moment which is considered to be the moment when the athlete has pushed their feet off from the starting block. This moment is then compared to the moment the starting signal was issued so as to determine whether a false start has occurred. One existing false start detection system is disclosed in U.S. Pat. No. 6,002,336 to LYNX SYSTEM DEVELOPER, INC.

In all sprint events run under the International Association of Athletics Federations (IAAF) rules, a false start will be considered to have occurred if a starting action of the athlete is determined to have occurred earlier than 100 ms after the start signal was issued. This is because it was understood that the time taken for an athlete to respond to an auditory starting signal and begin pushing the starting blocks was rarely less than 100 ms. However, the study "*IAAF Sprint Start Research Project: is the* 100 *ms limit still valid*?" by Komi et al. (New Studies in Athletics, no. 24(1): 37-47) has shown that auditory reaction time of athletes in a laboratory based environment is frequently less than 100 ms. In this study, reaction times of athletes were measured using high-speed cameras, EMG units and a multi-purpose force plate in a laboratory environment. The study demonstrated that the onset of leg force reaction was on average 98 ms after the auditory starting signal and in the fastest case was 78 ms after the auditory starting signal. In addition, the arm force reaction was on average 69 ms after the auditory starting signal, and in the fastest case was 49 ms after the auditory starting signal. In addition, EMG data showed that EMG signals for the erector spinae began on average 87 ms after the auditory starting signal, and in the fastest case was 69 ms after the auditory starting signal. The EMG data further showed that the EMG signals for the vastus medialis began on average 94 ms after the auditory starting signal, and in the fastest case was 73 ms after the auditory starting signal. The EMG data further showed that the EMG signals for the medial gastrocnemius began on average 96 ms after the auditory starting signal, and in the fastest case was 82 ms after the auditory starting signal. The EMG data further showed that the EMG signals for the tibalis anterior began on average 74 ms after the auditory starting signal, and in the fastest case was 59 ms after the auditory starting signal.

The study therefore highlighted that existing starting block systems that measure the leg force reaction data are not capable of detecting an athlete's first response to the starting signal. The study proposed lowering the IAAF 100 ms limit to 80 ms or 85 ms. In addition, the study proposed a kinematic false start detection system so that the detection of the starting action takes place based on the first visible movement of the athlete. The proposed false start detection system used a system of high-speed cameras to monitor the athletes in the starting position and detect the first visible movement of the athlete as the athlete start time.

Other studies have shown that existing IAAF approved systems which do not operate in laboratory conditions should have reaction time delays of 115-119 ms for detecting false starts. These existing systems appear to introduce reaction time detection delays due to inadequacies in the technology and event detection algorithms.

It is an objective of the present invention to provide a better or simpler false start detection system, or at least an alternative false start detection system to the existing systems outlined above.

According to the present invention there is provided an apparatus and method as set forth in the appended claims. Other features of the invention will be apparent from the dependent claims, and the description which follows.

According to a first aspect of the invention there is provided a method of determining whether an athlete has performed a false start in an event, the method comprising: receiving, from a force sensor, force data representing the force exerted by at least one upper appendage of the athlete on a surface when in a starting position; processing the force data to determine an athlete start time for the event; and comparing the athlete start time to the event start time to determine whether a false start has occurred.

Here, "upper appendage" may refer to part or all of the hand or arm of the athlete. The upper appendage may also refer to part or all of a prosthetic hand or prosthetic arm of the athlete.

Here, "athlete start time" refers to the time at which the athlete is determined to have started the event.

Here, "event start time" refers to the time at which the event is deemed to have started. This may be the time at which a starting signal has issued.

Advantageously, the method processes force data representing the force exerted by at least one upper appendage of the athlete on a surface so as to determine an athlete start time. The method then compares this determined athlete start time to an event start time to determine whether a false start has occurred. While the study outlined above did identify in a laboratory setting that the athlete's arm force reaction may occur earlier than the leg force reaction, the study did not realise that the arm force data itself could be processed to determine an athlete start time. This distinction may at first glance appear subtle, but it is significant. This distinction means that the present method uses the arm (or upper appendage) force data to determine whether a false start has occurred. A complicated system of high speed cameras, as proposed by the study, is not required, and thus the present method is simpler and more cost-effective. This is because relatively simple force sensors rather than complicated and expensive high speed cameras are used. In addition, the present method does not require complicated image processing operations to detect the first visible movement of the athlete and so determine the athlete start time.

Instead, the present method determines the athlete start time through the computationally simpler operation of processing force data.

While the present method is simpler than the false start detection system of the study, it still achieves the improvements over the existing foot block sensors. This is because it has been advantageously realised that the force data exerted by the at least one upper appendage of the athlete on the surface when in the starting position can itself be used to determine an athlete start time that better reflects the true time it takes the athlete to respond to a starting signal. In particular, tests conducted on a false start detection system incorporating the present method have shown that the athlete start time as detected by the present method precedes an athlete start time detected using existing foot block sensors by between 40 to 100 ms.

In some ways, the present method could be viewed as taking the benefit of the analysis of the study, but implementing practically using technology which is simple to use and cost-effective. In this way, the present method is also able to achieve the benefits of the existing footplate based sensor systems as well.

The force data may comprise the force exerted by the athlete over time. The force data may be in the form of a 2000-4000 Hz vertical force signal. The force signal may be a single channel high frequency signal. Advantageously, using a single channel signal means that it is easier to perform false start detection for multiple athletes because there is only 1 channel per athlete.

Processing the force data may be performed in real-time or may be performed after the event. Processing the force data in real-time may be used to provide real-time false start detection. Processing the force data after the event may be used in post-event analysis.

Comparing the athlete start time and the event start time may comprise determining whether the athlete start time is less than a predetermined threshold after the event start time, and, if so, determining that a false start has occurred.

The predetermined threshold may be less than or equal 100 ms. The predetermined threshold may be less than or equal to 90 ms. The predetermined threshold may be less than or equal to 80 ms. The predetermined threshold may be selected as the expected time it takes for the at least one upper appendage to begin reacting to a starting signal issued at the event start time. The starting signal may be an auditory signal issued by a starting gun.

Processing the force data may comprise identifying the occurrence of a starting action of the at least one upper appendage of the athlete from the force data, and may comprise setting the athlete start time using the identified occurrence of the starting action.

Setting the athlete start time may comprise setting the athlete start time to be the moment the at least one upper appendage of the athlete begins the starting action.

Here, "starting action" refers to the action taken by the athlete in starting the event. For example, in foot races the starting action may involve the athlete pushing off from the starting block so as to transition from a crouched stationary position to an up-right running position. During this starting action, the force exerted by the at least one upper appendage on the surface changes and is used to detect the athlete starting time.

Advantageously, the present method may detect the first response of the athlete to the starting signal issued at the event start time. This is unlike existing footplate based systems which identify the moment of maximum force on the force sensor or the moment the foot lifts off the foot sensor as the athlete start time. Research has shown that the moment the foot lifts off the foot sensor is not the first response of the athlete to the starting signal.

Processing the force data may comprise identifying one or more transition points in the force data occurring during the starting action, and may comprise setting the time at which one of the transition points occurs as the athlete start time.

Here, a "transition point" refers to a point of change in the gradient of the force data. The transition point may be a specific and characteristic change in the gradient. The one or more transition points may be points where a constant value of force data begins to increase or decrease. The one or more transition points may be one or more local minima or maxima in the force data.

Identifying one or more transition points may comprise identifying a first transition point representing the moment that the at least one upper appendage of the athlete begins the starting action, and may comprise setting the time at which the first transition point occurs as the athlete start time. The first transition point may be a local minima in the force data.

Advantageously, rather than identifying a moment of maximum force on the force sensor or a moment the at least one upper appendage lifts off from the surface as the athlete start time, the present method identifies an earlier first transition point that represents the moment that the at least one upper appendage of the athlete begins the starting action, and uses this to set the athlete start time. In this way, the present method identifies the first response of the athlete to the starting signal.

Identifying the first transition point may comprise identifying a second transition point representing a moment of maximum force exerted by the at least one upper appendage of the athlete on the surface during the starting action. Identifying the first transition point may comprise identifying a transition point preceding the second transition point as the first transition point. The second transition point may be a local maxima in the force data.

Advantageously, the present method uses the moment of maximum force exerted by the at least one upper appendage of the athlete on the surface to identify the first transition point. The moment of maximum force is computationally efficient to identify in the force data.

Identifying the second transition point may comprise identifying a third transition point representing the moment that the at least one upper appendage of the athlete lifts off the surface during the starting action. Identifying the second transition point may comprise identifying a transition point preceding the third transition point as the second transition point. The third transition point may be a local minima in the force data.

Advantageously, the present method uses the moment that the at least one upper appendage of the athlete lifts off the surface during the starting action to identify the second transition point. The moment the at least one upper appendage of the athlete lifts off the surface is computationally easy to identify in the force data.

Identifying the first transition point may comprise: identifying a sequence in the force data, the sequence representing a successive increase in the force exerted on the surface over time; and setting the start of the sequence as the first transition point. The end of the sequence may be set as the second transition point.

Identifying the sequence may comprise: calculating the rate of change of force data, and identifying a sequence of positive gradients from the rate of change of force data.

Processing the force data may comprise filtering the force data. Filtering the force data may comprise smoothing the force data. By filtering the force data, minor changes in the force data may be removed so as to reduce the likelihood of incorrectly detecting the start of the starting action.

Processing the force data may comprise calculating a first derivate of the force data with respect to time to generate first derivative data. Processing the force data may comprises calculating filtered first derivative data. Calculating filtered first derivative data may comprise applying a Savitzky-Golay digital filter to the force data.

Processing the force data may comprise applying a sign function to the first derivate data to generate a first sign function output.

Processing the force data may comprise filtering the first sign function output to obtain a filtered first sign function output. Filtering the first sign function output may comprise applying a moving average filter to the first sign function output. By filtering the first sign function output, minor changes may be removed so as to reduce the likelihood of false detection of the start of the starting action.

Processing the force data may comprise applying a sign function to the filtered first sign function output to generate a second sign function output. The second sign function output is made up of subsequences each containing coincident values, that is, subsequences containing all +1 values, or all −1 values, or all 0 values.

Processing the force data may comprise identifying at least two consecutive subsequences in which the last of the subsequences contains all −1 values, and in which the penultimate subsequence contains all +1 values. The athlete start time may be set as the start of the penultimate subsequence. That is, the transition point between the antepenultimate subsequence and the penultimate subsequence. The last subsequence terminates when the at least one upper appendage lifts from the surface.

Processing the force data may comprise identifying at least two consecutive subsequences in which the last of the subsequences contains all +1 values, and in which the penultimate subsequence contains all −1 values. The athlete start time may be set as the start of the last subsequence. That is, the transition point between the penultimate subsequence and the last subsequence. The last subsequence ends at the point when the at least one upper appendage exerts the maximum force on the surface during the starting action.

Advantageously, the present method is able to auto-adjust according to the mass of the athlete, the strength of the athlete, and the rate of force generation. This is because, by considering the change in force data rather than the magnitude of the force data, the present method automatically accounts for these variations amongst athletes. This is unlike existing systems which use the magnitude of the force data, and which typically have to be adjusted based on the weight of the athletes. In addition, the present method does not incorrectly identify an athlete start time as a result of minor fluctuations of force that are not part of the first response of the athlete to the starting signal.

The method may further comprise measuring, using the force sensor, the force exerted by the least one upper appendage of the athlete on the surface when in the starting position. Measuring the force may comprise measuring the ground reaction force under the at least one upper appendage using the force sensor.

The force data may represent the force exerted by one upper appendage of the athlete or two upper appendages of the athlete.

The event may be an athletics event. The athlete's starting position may be a crouched position. In the crouched position the athlete's at least one upper appendage may rest on the running surface, which may be the sensor, or be in physical contact with the sensor. The force data may represent the force exerted by the at least one upper appendage on the running surface. In the crouched position the lower appendages of the athlete may engage with a starting block.

The event may be a swimming event. The athlete's starting position may be with the at least one upper appendage of the athlete resting on a starting block. The force data may represent the force exerted by the at least one upper appendage on the starting block.

The method may comprise determining whether any of a plurality of athletes competing in the event has performed a false start. The method may comprise, for each athlete, receiving, from a force sensor, force data representing the force exerted by at least one upper appendage of the athlete on a surface when in a starting position; processing the force data to determine an athlete start time for the event; and comparing the athlete start time to the event start time to determine whether a false start has occurred.

According to a second aspect of the invention, there is provided a false start detection system for determining whether an athlete has performed a false start in an event, the system comprising: a processing module arranged to receive force data from a force sensor, the force data representing the force exerted by the at least one upper appendage of the athlete on a surface when in a starting position, the processing module being further arranged to process the force data to determine an athlete start time for the event; and a comparison module arranged to compare the athlete start time to an event start time representing the start of the event to determine whether a false start has occurred.

The system may further comprise a force sensor arranged to measure the force exerted by the at least one upper appendage of the athlete on a surface when in a starting position.

The force sensor may form part of or may be disposed in the vicinity of the surface.

The surface may be a running surface.

The event may be an athletics event. The athlete's starting position may be a crouched position. In the crouched position the athlete's at least one upper appendage may rest on the running surface. The force data may represent the force exerted by the at least one upper appendage on the running surface. In the crouched position the lower appendages of the athlete may engage with a starting block.

The false start detection system may further comprise a running track which forms the running surface.

The false start detection system may further comprise one or more attachment members for attaching the force sensor to the running surface.

The force sensor may be integrated into the running surface.

The false start detection system may further comprise a starting block.

The event may be a swimming event. The surface may be a surface of a starting block for use in the swimming event. The athlete's starting position may be with the at least one upper appendage of the athlete resting on the starting block. The force data may represent the force exerted by the at least one upper appendage on the starting block.

The comparison module may be arranged to determine whether a false start has occurred by determining whether the athlete start time is less than a predetermined threshold after the event start time, and if so, determine that a false start has occurred.

The predetermined threshold may be less than or equal 100 ms. The predetermined threshold may be less than or equal to 90 ms. The predetermined threshold may be less than or equal to 80 ms. The predetermined threshold may be selected as the expected time after which the at least one upper appendage begins reacting to a starting signal issued at the event start time. The starting signal may be an auditory signal issued by a starting gun.

The processing module may be arranged to process the force data so as to identify the occurrence of a starting action of the at least one upper appendage of the athlete from the force data, and may be arranged to set the athlete start time using the identified occurrence of the starting action.

The processing module may be arranged to set the athlete start time to be the moment the at least one upper appendage of the athlete begins the starting action.

The processing module may be arranged to process the force data so as to identify one or more transition points in the force data occurring during the starting action, and may be arranged to set the time at which one of the transition points occurs as the athlete start time.

The processing module may be arranged to identify one or more transition points by identifying a first transition point representing the moment that the at least one upper appendage of the athlete begins the starting action, and may be arranged to set the time at which the first transition point occurs as the athlete start time. The first transition point may be a local minima in the force data.

The processing module may be arranged to identify the first transition point by identifying a second transition point, the second transition point representing a moment of maximum force exerted by the at least one upper appendage of the athlete on the surface during the starting action. The processing module may be arranged to identify the first transition point by identifying a transition point preceding the second transition point as the first transition point. The second transition point may be a local maxima in the force data.

The processing module may be arranged to identify the second transition point by identifying a third transition point representing the moment that the at least one upper appendage of the athlete lifts off the surface during the starting action. The processing module may be arranged to identify the second transition point by identifying a transition point preceding the third transition point as the second transition point. The third transition point may be a local minima in the force data.

The processing module may be arranged to identify the first transition point by identifying a sequence in the force data, the sequence representing a successive increase in the force exerted on the surface over time; and setting the start of the sequence as the first transition point. The end of the sequence may be set as the second transition point.

The processing module may be arranged to identify the sequence by calculating the rate of change of force data, and identifying a sequence of positive gradients from the rate of change of force data.

The processing module may be arranged to filter the force data. The processing module may be arranged to filter the force data by smoothing the force data.

The processing module may be arranged to calculate a first derivate of the force data with respect to time to generate first derivative data. The processing module may be arranged calculate filtered first derivative data. The processing module may be arranged to calculate filtered first derivative data by applying a Savitzky-Golay digital filter to the force data.

The processing module may be arranged to apply a sign function to the first derivate data to generate a first sign function output.

The processing module may be arranged to filter the first sign function output to obtain a filtered first sign function output. The processing module may be arranged to filter the first sign function output by applying a moving average filter to the first sign function output.

The processing module may be arranged to apply a sign function to the filtered first sign function output to generate a second sign function output. The second sign function output may be made up of subsequences each containing coincident values, that is, subsequences containing all +1 values, or all −1 values, or all 0 values.

The processing module may be arranged to identify at least two consecutive subsequences in which the last of the subsequences contains all −1 values, and in which the penultimate subsequence contains all +1 values. The processing module may be arranged to set the athlete start time as the start of the penultimate subsequence. That is, the transition point between the antepenultimate subsequence and the penultimate subsequence. The last subsequence terminates when the at least one upper appendage lifts from the surface.

The processing module may be arranged to identify at least two consecutive subsequences in which the last of the subsequences contains all +1 values, and in which the penultimate subsequence contains all −1 values. The processing module may be arranged to set the athlete start time as the start of the last subsequence. That is, the transition point between the penultimate subsequence and the last subsequence. The last subsequence ends at the point when the at least one upper appendage exerts the maximum force on the surface during the starting action.

The false start system may be arranged to determine whether any of a plurality of athletes competing in the event have performed a false start. For each athlete, the processing module may be arranged to receive force data from a force sensor, the force data representing the force exerted by the at least one upper appendage of the athlete on a surface when in a starting position, the processing module being further arranged to process the force data to determine an athlete start time for the event. For each athlete, the comparison module may be arranged to compare the athlete start time to an event start time representing the start of the event to determine whether a false start has occurred.

According to a third aspect of the invention, there is provided a computer readable medium having instructions recorded thereon which, when executed by a processor, cause the processor to perform the method of the first aspect.

According to a fourth aspect of the invention, there is provided a false start detection sensor arranged to measure the force exerted by at least one upper appendage of an athlete on a surface when in a starting position.

The false start detection sensor may be arranged to be integrated in a running track.

The false start detection sensor may be arranged to extend along the width of a lane of the running track.

According to a fifth aspect of the invention, there is provided a method of determining whether an athlete has performed a false start in an event, the method comprising: receiving, from a force sensor, force data representing the force exerted by at least one appendage of the athlete on a surface when in a starting position; processing the force data to identify a first transition point representing the moment that the at least one appendage of the athlete begins a starting action; setting the time at which the first transition point occurs as an athlete start time for the event; and comparing the athlete start time to the event start time to determine whether a false start has occurred.

Advantageously, the method according to the fifth aspect has been found to be an improved method of detecting whether a false start has occurred, even if the force data used represents the force exerted by a lower appendage of the athlete on the surface rather than an upper appendage. This means that the method provides an improved method of false start detection over existing starting block based false start detection methods which use the point of maximum force exerted by the feet of the athlete or the moment of lift off from the block by the athlete as the athlete start time. Perhaps counter intuitively, the present method identifies a first transition point and uses this first transition point as the athlete start time. While the method according to the fifth aspect when used with lower appendage force sensors may only provide an improvement in false start detection of a few milliseconds, even this marginal improvement may have significant effect on the outcome of athletic events where often every millisecond counts.

The first transition point may be a local minima in the force data.

The predetermined threshold may be less than or equal 100 ms. The predetermined threshold may be less than or equal to 90 ms. The predetermined threshold may be less than or equal to 80 ms. The predetermined threshold may be selected as the expected time after which the at least one appendage begins reacting to a starting signal issued at the event start time. The starting signal may be an auditory signal issued by a starting gun.

Identifying the first transition point may comprise identifying a second transition point, the second transition point representing a moment of maximum force exerted by the at least one appendage of the athlete on the surface during the starting action. Identifying the first transition point may comprise identifying a transition point preceding the second transition point as the first transition point. The second transition point may be a local maxima in the force data.

Identifying the second transition point may comprise identifying a third transition point representing the moment that the at least one appendage of the athlete lifts off the surface during the starting action. Identifying the second transition point may comprise identifying a transition point preceding the third transition point as the second transition point. The third transition point may be a local minima in the force data.

Identifying the first point may comprise identifying a sequence in the force data, the sequence representing a successive increase in the force exerted on the surface over time; and setting the start of the sequence as the first transition point. The end of the sequence may be set as the second transition point.

Identifying the sequence may comprise calculating the rate of change of force data, and identifying a sequence of positive gradients from the rate of change of force data.

Processing the force data comprises filtering the force data. Filtering the force data may comprises smoothing the force data.

Processing the force data may comprise calculating a first derivate of the force data with respect to time to generate first derivative data. Processing the force data may comprise calculating filtered first derivative data. Calculating the filtered first derivative data may comprises applying a Savitzky-Golay digital filter to the force data.

Processing the force data may comprise applying a sign function to the first derivate data to generate a first sign function output.

Processing the force data may comprise filtering the first sign function output to obtain a filtered first sign function output. Filtering the first sign function output may comprises applying a moving average filter to the first sign function output.

Processing the force data may comprise applying a sign function to the filtered first sign function output to generate a second sign function output. The second sign function output may be made up of subsequences each containing coincident values, that is, subsequences containing all +1 values, or all −1 values, or all 0 values.

Processing the force data may comprise identifying at least two consecutive subsequences in which the last of the subsequences contains all −1 values, and in which the penultimate subsequence contains all +1 values. The athlete start time may be set as the start of the penultimate subsequence. That is, the transition point between the antepenultimate subsequence and the penultimate subsequence. The last subsequence terminates when the at least one appendage lifts from the surface.

Processing the force data may comprise identifying at least two consecutive subsequences in which the last of the subsequences contains all +1 values, and in which the penultimate subsequence contains all −1 values. The athlete start time may be set as the start of the last subsequence. That is, the transition point between the penultimate subsequence and the last subsequence. The last subsequence ends at the point when the at least one appendage exerts the maximum force on the surface during the starting action.

The at least one appendage may be a lower appendage. The lower appendage may be a foot, a limb, a prosthetic foot or a prosthetic limb.

According to a sixth aspect of the invention, there is provided a false start detection system for determining whether an athlete has performed a false start in an event, the system comprising: a processing module arranged to receive force data from a force sensor, the force data representing the force exerted by the at least one appendage of the athlete on a surface when in a starting position, the processing module being further arranged to process the force data to identify a first transition point representing the moment that the at least one appendage of the athlete begins a starting action, and set the time at which the first transition point occurs as an athlete start time for the event; and a comparison module arranged to compare the athlete start time to the event start time to determine whether a false start has occurred.

The first transition point may be a local minima in the force data.

The system may further comprise a force sensor arranged to measure the force exerted by the at least one appendage of the athlete on a surface when in a starting position.

The force sensor may be integrated into or attached to a starting block.

The false start detection system may further comprise a starting block.

The comparison module may be arranged to determine whether a false start has occurred by determining whether the athlete start time is less than a predetermined threshold after the event start time, and if so, determine that a false start has occurred.

The predetermined threshold may be less than or equal 100 ms. The predetermined threshold may be less than or equal to 90 ms. The predetermined threshold may be less than or equal to 80 ms. The predetermined threshold may be selected as the expected time after which the at least one appendage begins reacting to a starting signal issued at the event start time. The starting signal may be an auditory signal issued by a starting gun.

The processing module may be arranged to identify the first transition point by identifying a second transition point, the second transition point representing a moment of maximum force exerted by the at least one appendage of the athlete on the surface during the starting action. The processing module may be arranged to identify the first transition point by identifying a transition point preceding the second transition point as the first transition point. The second transition point may be a local maxima in the force data.

The processing module may be arranged to identify the second transition point by identifying a third transition point representing the moment that the at least one appendage of the athlete lifts off the surface during the starting action. The processing module may be arranged to identify the second transition point by identifying a transition point preceding this moment as the second transition point. The third transition point may be a local minima in the force data.

The processing module may be arranged to identify the first transition point by identifying a sequence in the force data, the sequence representing a successive increase in the force exerted on the surface over time; and setting the start of the sequence as the first transition point. The end of the sequence may be set as the second transition point.

The processing module may be arranged to identify the sequence by calculating the rate of change of force data, and identifying a sequence of positive gradients from the rate of change of force data.

The processing module may be arranged to filter the force data. The processing module may be arranged to filter the force data by smoothing the force data.

The processing module may be arranged to calculate a first derivate of the force data with respect to time to generate first derivative data. The processing module may be arranged to calculate filtered first derivate data. The processing module may be arranged to calculate the filtered first derivative data by applying a Savitzky-Golay digital filter to the force data.

The processing module may be arranged to apply a sign function to the first derivate data to generate a first sign function output.

The processing module may be arranged to filter the first sign function output to obtain a filtered first sign function output. The processing module may be arranged to filter the first sign function output by applying a moving average filter to the first sign function output.

The processing module may be arranged to apply a sign function to the filtered first sign function output to generate a second sign function output. The second sign function output may be made up of subsequences each containing coincident values, that is, subsequences containing all +1 values, or all −1 values, or all 0 values.

The processing module may be arranged to identify at least two consecutive subsequences in which the last of the subsequences contains all −1 values, and in which the penultimate subsequence contains all +1 values. The processing module may be arranged to set the athlete start time as the start of the penultimate subsequence. That is, the transition point between the antepenultimate subsequence and the penultimate subsequence. The last subsequence terminates when the at least one upper appendage lifts from the surface.

The processing module may be arranged to identify at least two consecutive subsequences in which the last of the subsequences contains all +1 values, and in which the penultimate subsequence contains all −1 values. The processing module may be arranged to set the athlete start time as the start of the last subsequence. That is, the transition point between the penultimate subsequence and the last subsequence. The last subsequence ends at the point when the at least one appendage exerts the maximum force on the surface during the starting action.

The false start system may be arranged to determine whether any of a plurality of athletes competing in the event have performed a false start. For each athlete, the processing module may be arranged to receive force data from a force sensor, the force data representing the force exerted by the at least one appendage of the athlete on a surface when in a starting position, the processing module being further arranged to process the force data to determine an athlete start time for the event. For each athlete, the comparison module may be arranged to compare the athlete start time to an event start time representing the start of the event to determine whether a false start has occurred.

According to a seventh aspect of the invention, there is provided a method of determining whether an athlete has formed a stationary set position during an event, the method comprising: receiving, from a force sensor, force data representing the force exerted by at least one appendage of the athlete on a surface when in a starting position; processing the force data to determine whether the set position is sufficiently stationary, and if it is determined that the athlete is not in a sufficiently stationary set position, identifying the athlete as having not formed a stationary set position.

Processing the force data may comprise identifying the magnitude of the force exerted by the at least one appendage on the surface while the athlete is in the starting position. The processing may comprise determining that the athlete is not in a sufficiently stationary set position based on whether the magnitude of the force exceeds a selected threshold. The processing may comprise determining that the athlete is not in a sufficiently stationary set position based on how many times the magnitude of the force exceeds the selected threshold.

Processing the force data may comprise calculating the rate of change of force exerted by the at least one appendage while the athlete is in the starting position. The processing may comprise determining that the athlete is not in a sufficiently stationary set position based on whether the rate of change of the force exceeds a selected threshold. The processing may comprise determining that the athlete is not in a sufficiently stationary set position based on how many times the rate of change of the force exceeds the selected threshold.

The stationary set position may refer to a gesture that the athlete adopts while in the starting position, but prior to the athlete performing the starting action. The set position may be required to be formed in the event, such as in response to the event starter issuing the command "set". The set position may be a set position as defined by IAAF rule 162.

Advantageously, the method may determine whether the athlete has adopted (within reason) a stationary set position within a reasonable time period after the "set" command from the event starter. The transition points in the force data may demonstrate when athletes have not adopted a stationary set position.

In such cases where the athlete has not adopted a stationary set position within a reasonable time period after the command set, then the method according to the first aspect may warn the starter and the start may be aborted. The method may allow the starter to receive additional information demonstrating that athletes have achieved a stationary set position within a reasonable time period (as determined by the starter). Any or all athletes that are not complying with the rule to adopt a stationary set position may be warned by the starter.

The method according to the seventh aspect may be incorporated into the methods/systems according to any of the first to sixth aspects. In this way, a combined false start detection and stationary set position detection method/system may be provided. The stationary set position may be detected using upper appendage force data or lower appendage force data.

According to an eighth aspect of the invention, there is provided a system for performing the method according to the seventh aspect.

At least some of the example embodiments described herein may be constructed, partially or wholly, using dedicated special-purpose hardware. Terms such as 'component', 'module' or 'unit' used herein may include, but are not limited to, a hardware device, such as circuitry in the form of discrete or integrated components, a Field Programmable Gate Array (FPGA) or Application Specific Integrated Circuit (ASIC), which performs certain tasks or provides the associated functionality. In some embodiments, the described elements may be configured to reside on a tangible, persistent, addressable storage medium and may be configured to execute on one or more processors. These functional elements may in some embodiments include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. Although the example embodiments have been described with reference to the components, modules and units discussed herein, such functional elements may be combined into fewer elements or separated into additional elements.

For a better understanding of the invention, and to show how embodiments of the same may be carried into effect, reference will now be made, by way of example only, to the accompanying diagrammatic drawings in which.

Figure 1:
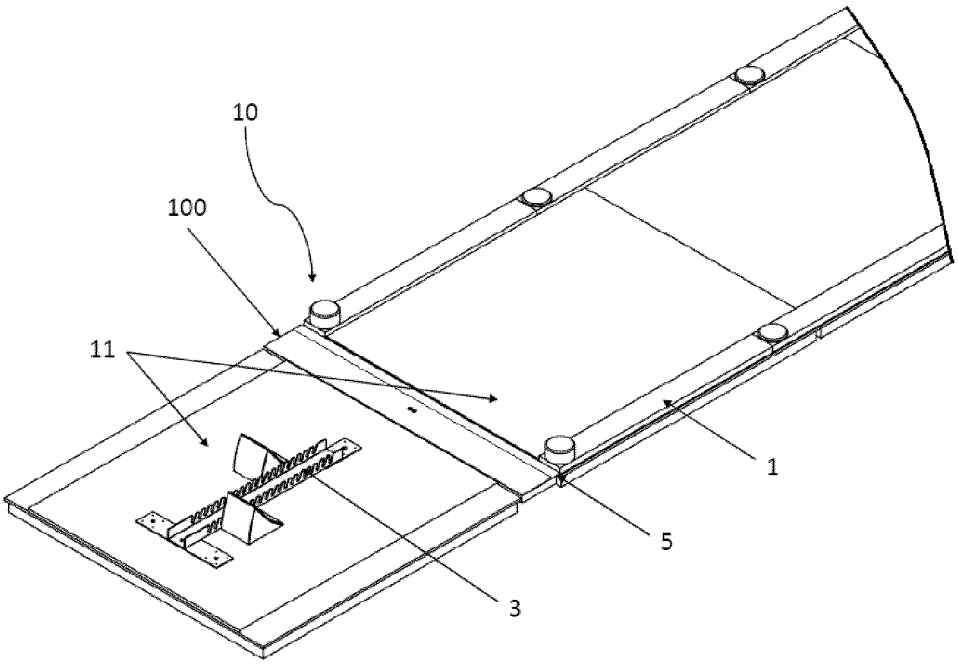
FIG. 1 shows a perspective view of an example false start detection system according to the second aspect.

Referring to FIG. 1 there is shown part of an example false start detection system indicated generally by the reference numeral 10. A running track 1 forms a running surface over which athletes may run in athletics events. In FIG. 1, the running track 1 has a single running lane, but it will be appreciated that in other arrangements the running track 1 will have multiple running lanes so that multiple athletes may compete in the event. The running track 1 includes a starting area 11 in which an athlete forms a starting position before starting the athletics event. The starting area 11 includes a starting block 3 in which the feet of the athlete may rest when in the starting position. The end of the starting area 11 is indicated by starting line 5 which may be a visual line on the running surface. In addition and significantly, a force sensor 100 is provided in starting area 11 proximal to the starting line 5 and extending across the width of the running track 1. The force sensor 100 is arranged at a position where at least one upper appendage of the athlete will rest on the running surface when in the starting position. The at least one upper appendage will typically be one or both hands of the athlete. The force sensor 100 is therefore arranged in such a way that it can measure the force exerted by an upper appendage of an athlete on the running surface while in the starting position.

Figure 2:
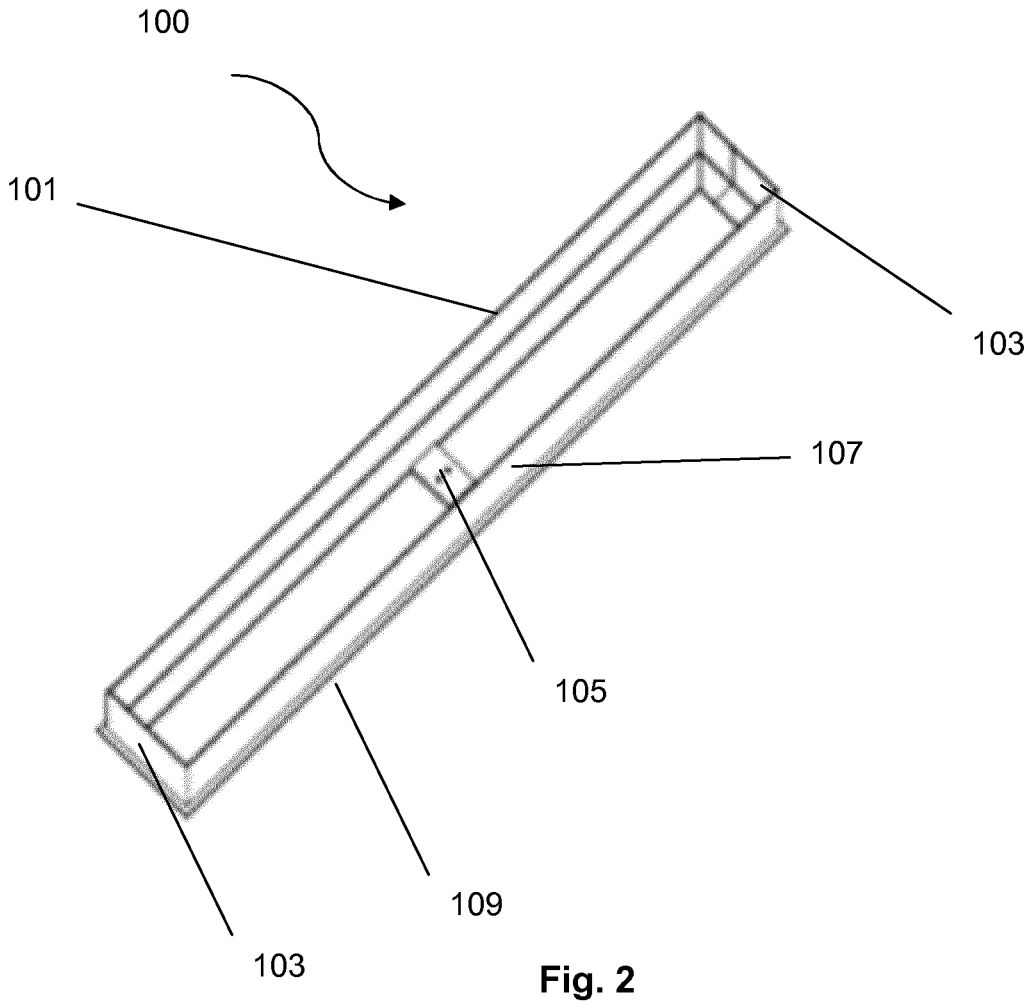
FIG. 2 shows a perspective view of an example housing for a force sensor according to second aspect.

Referring to FIG. 2, the force sensor 100 has a housing 101 sized and shaped to fit within a trough formed in the running track 1 (FIG. 1) and extending along the width of a lane of the running track 1. In this way, the force sensor 100 may be integrated into the running track 1 without substantially affecting the running surface. The housing 101 has a frame with a C-shaped central section 107 and end pieces 103 attached or integrally formed with the central section 107. The housing 101 further includes a front plate 109 with an attachment point 105 where a load cell 111 (FIG. 3) of the force sensor 100 may be attached.

Figure 3:
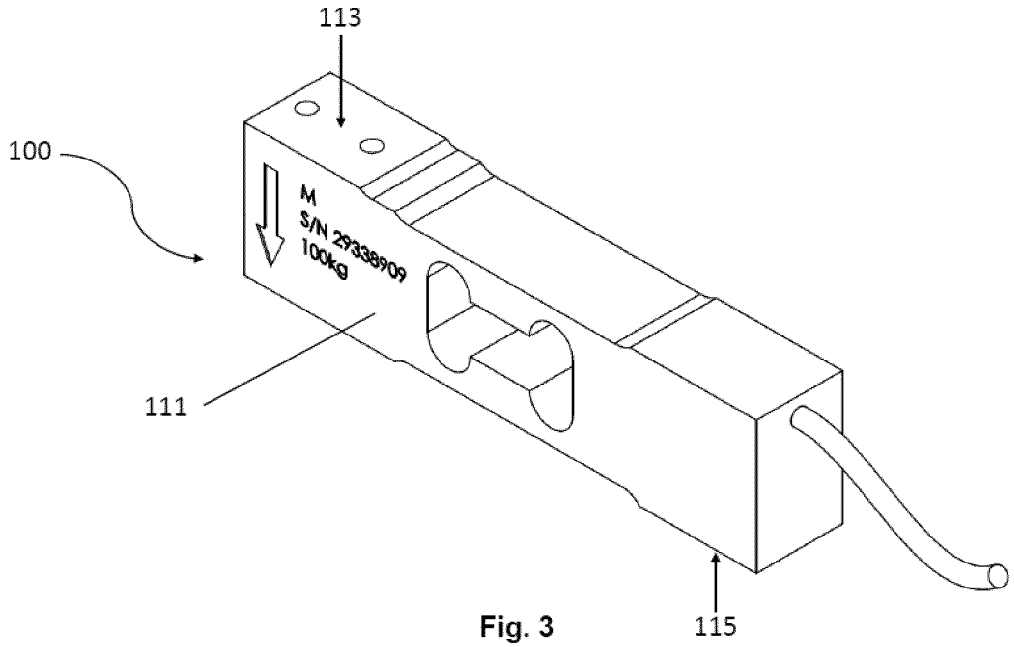
FIG. 3 shows a perspective view of an example load cell for a force sensor according to the second aspect.

Referring to FIG. 3, there is shown an example load cell 111 of the force sensor 100. The load cell 111 has a top fixation point 113 allowing it to be attached to the front plate 109 of the housing 101, and a bottom fixation point 115 allowing it to be attached to a base or a floor. By this arrangement, the force sensor 100 may be integrated into the running track 1.

In another arrangement, one or more attachment members (not shown) are provided for attaching the force sensor 100 to the running surface. In this arrangement, the load cell 111 is selected to have a thin profile such that the force sensor 100 does not significantly interfere with the running surface. In this arrangement, a housing 101 for the force sensor 100 may not be required.

In both arrangements, the force sensor 100 may be covered in a material so as to help it blend into the running surface. The material in some examples is synthetic track material which may be the same as or similar to the track material used to form the running track 1. By these arrangements, the false start detection system 10 does not significantly interfere with the running surface.

Figure 4:
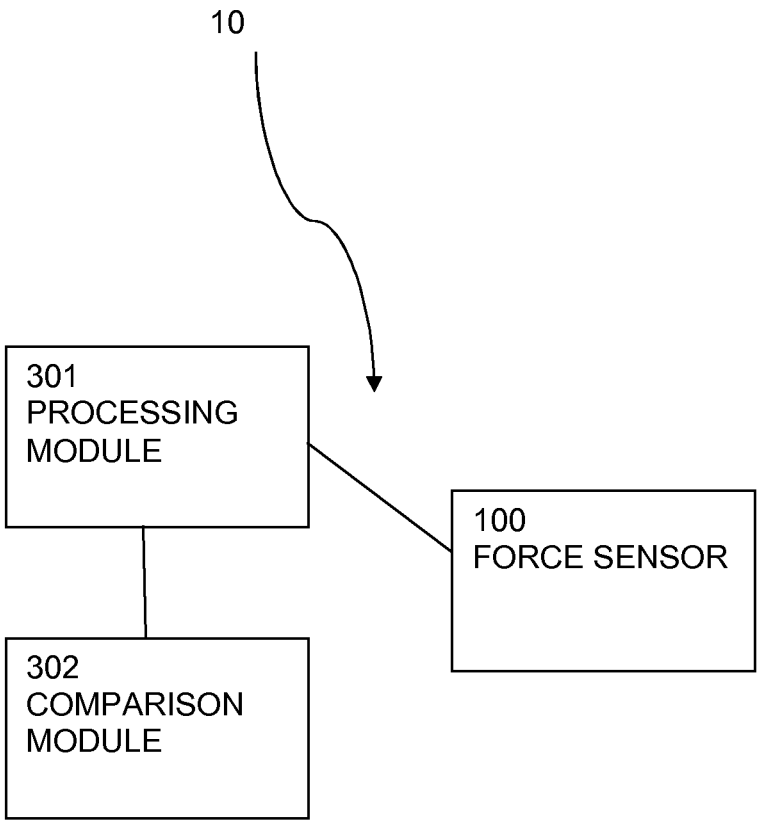
FIG. 4 shows an example false start detection system according to the second and sixth aspects.

Referring to FIG. 4 there is shown a schematic view of components of the false start detection system 10. Processing module 301 is arranged to receive force data from the force sensor 100. The processing module 301 processes the force data to determine an athlete start time for the event. Comparison module 302 receives the athlete start time from the processing module 301 and compares the athlete start time to an event start time representing the start of the event so as to determine whether a false start has occurred. In an example, the start of the event will be signified by the firing of a starting gun, and the comparison module 302 will receive an event time indicating the moment the starting gun was fired.

The processing module 301 and comparison module 302 may be implemented by a processor of a single computing device. The single computing device may be connected to the force sensor 100 by a wired or wireless connection such that it can receive force data from the force sensor 100. In other arrangements, the processing module 301 and comparison module 302 may be separate, discrete units, which are able to communicate with one another over a wired or wireless connection.

The comparison module 302 is arranged to determine whether a false start has occurred by determining whether the athlete start time is less than a predetermined threshold after the event start time. If the athlete start time is less than the predetermined threshold after the event start time, then the comparison module 302 determines that a false start has occurred. The predetermined threshold is selected as the expected time after which the at least one upper appendage begins reacting to a starting signal issued at the event start time. In one example, the predetermined threshold is less than or equal 100 ms. In another example, the predetermined threshold is less than or equal to 90 ms. In another example, the predetermined threshold is less than or equal to 80 ms.

In one example, the false start system 10 is arranged to determine whether any of a plurality of athletes competing in the event have performed a false start. In this example, the running track 1 (FIG. 1) has a plurality of lanes. Each lane has a force sensor 100 (FIG. 1) extending across the width of the lane within the starting area 11 (FIG. 1), such that each force sensor 100 is able to measure the force exerted by at least one upper appendage of one athlete on the surface when in a starting position. The starting areas 11 may be placed at staggered positions many meters apart such as for 400 m foot races.

Each of the force sensors 100 are arranged to provide force data to the processing module 301 (FIG. 4). Each force sensor 100 provides the force data on a single channel different to the channel used by the other force sensors 100. The force data is provided as a high frequency signal in the form of a 2000-4000 Hz vertical force signal. In this way, the processing module 301 is arranged, for each athlete, to receive force data from a force sensor 100, the force data representing the force exerted by the at least one upper appendage of the athlete on a surface when in a starting position. The processing module 301 is further arranged, for each athlete, to process the force data to determine an athlete start time for the event. For each athlete, the comparison module 302 (FIG. 4) is arranged to compare the athlete start time to an event start time representing the start of the event to determine whether a false start has occurred. In another example, each force sensor 100 may be associated with its own processing module 301 and/or comparison module 302.

Figure 5:
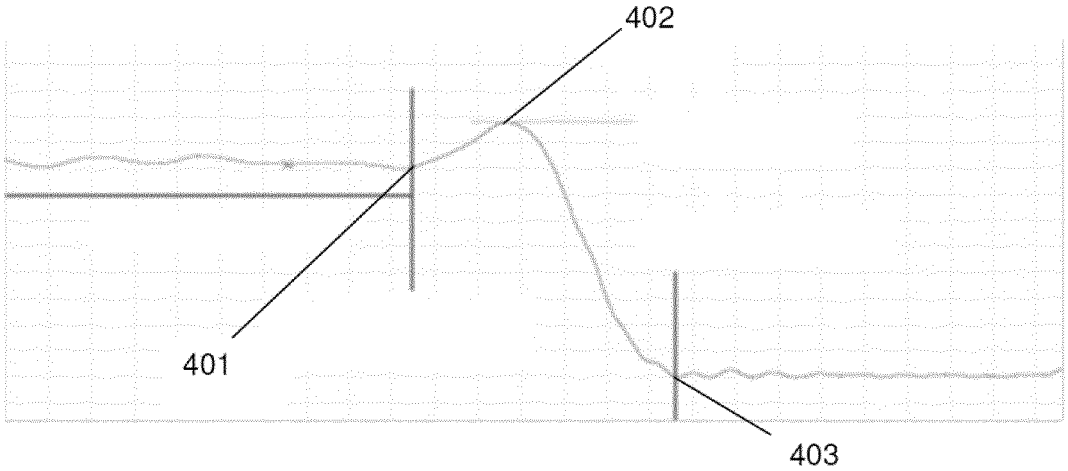
FIG. 5 shows a graph of upper appendage force data over time according to aspects of the present invention.

Referring to FIG. 5 there is shown an example graph of the force data received by the processing module 301 (FIG. 4) over time. The graph includes a first region where the athlete is effectively stationary in the starting position. This may be referred to as the athlete being in the "set" position. At first transition point 401, the upper appendage of the athlete begins to react and start a starting action. From first transition point 401, the force exerted by the upper appendage as measured by the force sensor 100 rises until second transition point 402 which is a point of maximum force during the starting action. From second transition point 402, the force exerted by the upper appendage on the surface decreases until third transition point 403 where the athlete's upper appendage is lifted entirely from the surface. From third transition point 403 onwards, a baseline force data signal is received indicating that the upper appendage is no longer exerting force on the surface.

The processing module 301 (FIG. 4) determines the athlete start time to be the moment the at least one upper appendage of the athlete begins the starting action. That is, the processing module 301 processes the force data to identify first transition point 401 as shown in FIG. 5 which is a first local minima 401.

In on example, the processing module 301 identifies the first local minima 401 by identifying the moment the at least on upper appendage is lifted from the surface. That is, the processing module 301 identifies the third transition point 403, which is also a local minima 403. The processing module 301 identifies a transition point preceding the third transition point 403. The identified transition point is shown as second transition point 402 in FIG. 5 and is a local maxima. The identified local maxima 402 represents the point of maximum force exerted by the upper appendage of the athlete on the surface during the starting action. The processing module 301 identifies a transition point preceding the identified local maxima 402 as the first local minima 401.

In another example, the processing module 301 identifies the first local minima 401 by identifying a sequence in the force data representing a successive increase in the force exerted on the surface over time. The sequence is shown in FIG. 5 as the period of successive increase in the force exerted on the surface between transition points 401 and 402. The first local minima 401 is set as the start of the sequence. The local maxima 402 may be identified as the end of the sequence. The processing module 301 identifies the sequence by calculating a rate of change of force data, and identifying a sequence of positive gradients from the rate of change of force data.

In one example, the first local minima/transition point 401 is identified using the following operation which involves calculating the rate of change of force data.

For this example, the force data is denoted by $y_1$, $y_2, \ldots, y_n, y_{n+1}$, where $y_1$ is the first value of force data recorded and $y_n$ is the final value recorded before the athlete's upper appendage leaves the surface. The force data $y_{n+1} \ldots$ denotes force data recorded after the athlete's upper appendage leaves the surface.

The processing module 301 (FIG. 4) use a Savitzky-Golay filter to obtain a smoothed estimate, $d_t$, of the first derivative of the force data at time point t. The smoothed estimate, $d_t$, is calculated for each centred subsequence of length (2m+1) using Equation 1.

$$d_t = \sum_{i=\frac{1-m}{2}}^{\frac{m-1}{2}} c_i y_{t+i} \qquad \text{Equation 1}$$

The filter coefficients, $c_i$ are calculated according to Equation 2.

$$c_i = \frac{75(3m^4 - 18m^2 + 31)i - 420(3m^2 - 7)i^2}{m(m^2 - 1)(3m^4 - 39m^2 + 108)} \qquad \text{Equation 2}$$

In this example, a value of m=5 is used.

The processing module 301 applies a sign function to the smoothed estimate, $d_t$, in accordance with Equation 3 so as to obtain a first sign output.

$$s_t = \text{sign}(d_t) \qquad \text{Equation 3}$$

Here, sign($d_t$) is defined according to Equation 4.

$$\text{sign}(a) = \begin{cases} -1, & \text{if } a < 0 \\ +1, & \text{if } a > 0 \\ 0, & \text{if } a = 0 \end{cases} \quad \text{Equation 4}$$

The processing module 301 applies a (2p+1) point moving average filter to the first sign output, $s_t$, to obtain a filtered first sign output. The processing module 301 applies a sign function to the filtered first sign output so as to obtain a second sign output. These operations are in accordance with Equation 5.

$$\tilde{s}_t = \text{sign}\left(\frac{1}{2p+1}\sum_{i=\frac{1-p}{2}}^{\frac{p-1}{2}} s_{t+i}\right) \quad \text{Equation 5}$$

Here, sign is defined in accordance with Equation 4. In this example, a value of p=2 is used.

The second sign output includes a sequence of signed differences $\{\tilde{s}_t\}$ made up of subsequences $S_1, \ldots, S_N$ each containing coincident values. That is subsequences containing all +1 values, or all −1 values, or all 0 values.

The processing module 301 may only be required to store the two or three most recent subsequences $S_{N-2}$, $S_{N-1}$, $S_N$, or in most cases only the timings of these subsequences.

In one example, the final subsequence $S_N$ contains all −1 values and terminates when the upper appendage of the athlete lifts from the surface. In effect, the end of the final subsequence $S_N$ identifies the moment where the upper appendage of the athlete lifts from the surface. That is, the end of the final subsequence $S_N$ identifies the third transition point 403 (FIG. 5).

The start of the final subsequence $S_N$ identifies the moment of maximum force exerted by the upper appendage on the surface. That is, the start of the final subsequence $S_N$ identifies the second transition point 402 (FIG. 5). The penultimate subsequence $S_{N-1}$ contains all +1 values. That is, the end of the penultimate subsequence $S_{N-1}$ identifies the moment of maximum force exerted by the upper appendage on the surface, i.e. second transition point 402. The start of the penultimate subsequence $S_{N-1}$ identifies the moment the at least one upper appendage of the athlete begins the starting action, That is, the start of the penultimate subsequence $S_{N-1}$ identifies the first transition point 401 (FIG. 5).

In another example, the final subsequence $S_N$ contains all +1 values and ends at the point when the at least one appendage exerts the maximum force on the surface during the starting action. That is, the end of the final subsequence $S_N$ identifies the second transition point 402 (FIG. 5).

The start of the final subsequence $S_N$ identifies the moment the at least one upper appendage of the athlete begins the starting action. That is, the start of the final subsequence $S_N$ identifies the first transition point 401 (FIG. 5).

In both examples, a transition point between a sequence of force data having positive gradients (+1 values) and a sequence of force data having negative gradients (−1 values) is set as the first transition point 401 indicating the moment the at least one upper appendage of the athlete begins the starting action.

It will be appreciated that the above example relates to one way of identifying the first transition point 401. Other ways of identifying the first transition point 401 are within the scope of the present application.

For example, image recognition algorithms could be used to analyse a graph of the force data plotted against time, and identify the first transition point 401. The image recognition algorithms could compare the identified first transition point 401 with a visual representation of the event start time in the graph so as to determine whether a false start has occurred.

Figure 6:
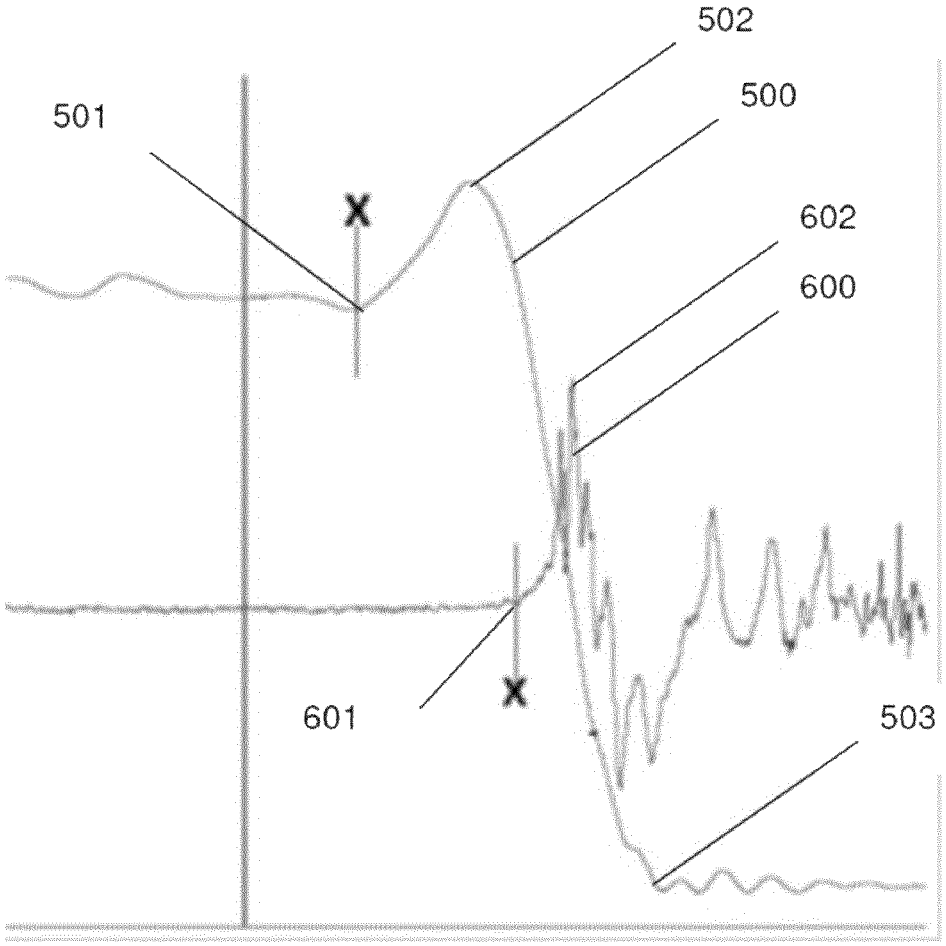
FIG. 6 shows a graph of upper appendage and lower appendage force data over time according to aspects of the present invention.

Referring to FIG. 6, there is shown an example graph comparing force data representing the force exerted by an upper appendage of the athlete on the surface in response to a starting signal and accelerometer data relating to a lower appendage of the athlete on the starting block 3 (FIG. 1). The upper appendage force data is indicated by the line 500, and the lower appendage accelerometer data is indicated by the line 600.

From FIG. 6, it can be appreciated that the upper appendage begins reacting to the starting signal at a significantly earlier moment than the lower appendage. In particular, the first transition point 501 representing the moment that the upper appendage begins reacting to the starting signal occurs significantly earlier than the moment 601 where the lower appendage begins reacting to the starting signal. In addition, the second transition point 502 representing the moment that the upper appendage exerts the maximum force on the surface during the starting action occurs earlier than the moment of maximum acceleration 602. Significantly therefore, the false start detection system 10 is able to determine an athlete start time that better reflects the true time it takes the athlete to respond to a starting signal than the existing systems that measure the lower appendage interaction with the starting block 3. Tests conducted on example false start detection system 10 have shown that the athlete start time as detected precedes an athlete start time detected using existing foot block sensors by between 40 to 100 ms.

From FIG. 6, the third transition point 503 representing the movement the upper appendage lifts off from the surface occurs at a similar time to the moment the lower appendage lifts off from the starting block 3. This may mean that in some arrangements the false start detection system 10 of the present invention still takes a similar amount of time to determine whether a false start has occurred because it still needs to wait a similar amount of time to receive the required force data. Significantly, however, the false start determination will be more accurate because an earlier moment is identified as the moment that the athlete begins the starting action than existing systems that measure the interaction between the lower appendage and the starting block 3.

Figure 7:
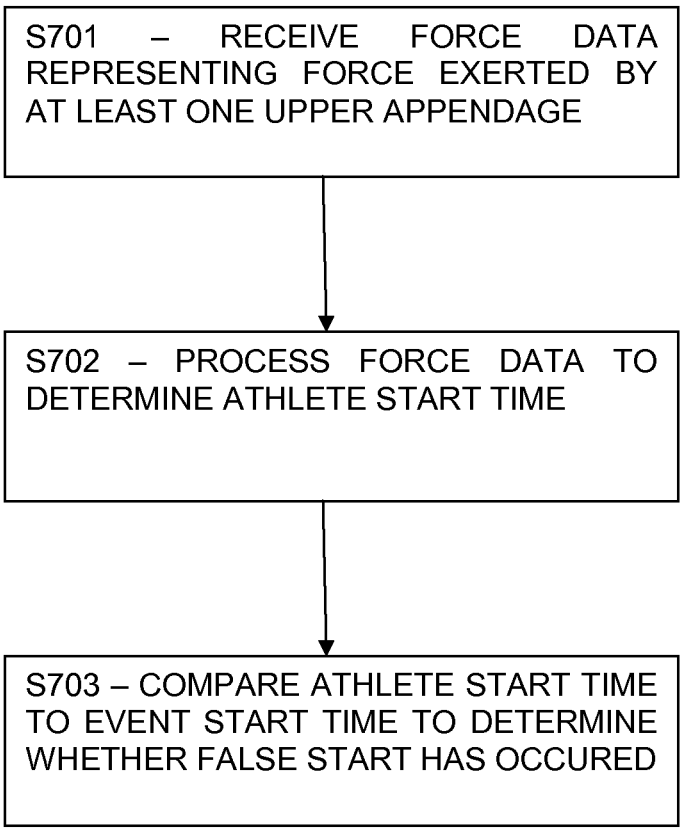
FIG. 7 shows a flow diagram for a method according to the first aspect.

Referring to FIG. 7, there is shown a flow diagram of a method according to the first aspect.

In step 701, force data is received, from a force sensor 100 (FIG. 1). The force data represents the force exerted by at least one upper appendage of the athlete on a surface when in a starting position.

In step 702, the force data is processed to determine an athlete start time for the event. This involves identifying the occurrence of a starting action of the at least one upper appendage of the athlete from the force data. The athlete start time is set to be the moment the at least one upper appendage of the athlete begins the starting action.

In one example, step 702 involves identifying a first transition point 401 (FIG. 5) representing the moment that the at least one upper appendage of the athlete begins the starting action. The time at which the first transition point 401 occurs is set as the athlete start time.

In one example, the first transition point 401 is identified by a second transition point 402 (FIG. 5) representing a moment of maximum force exerted by the at least one upper appendage of the athlete on the surface during the starting action. A transition point 401 preceding the second transition point 402 is identified as the first transition point 401. The second transition point 402 may be identified by identifying the third transition point 403 (FIG. 5) representing the moment that the at least one upper appendage of the athlete lifts off the surface during the starting action. A transition point 402 preceding this third transition point 403 is identified as the second transition point 402.

In another example, the first transition point 401 is identified by identifying a sequence in the force data representing a successive increase in the force exerted on the surface over time. The first transition point 401 is set as the start of the sequence.

In one example, the first transition point 401 is identified using the following operation.

For this example, the force data is denoted by $y_1$, $y_2, \ldots, y_n, y_{n+1}$, where $y_1$ is the first value of force data recorded and $y_n$ is the final value recorded before the athlete's upper appendage leaves the surface. The force data $y_{n+1} \ldots$ denotes force data recorded after the athlete's upper appendage leaves the surface.

A Savitzky-Golay filter in accordance with Equations 1 and 2 is applied to the force data to obtain a smoothed estimate, $d_t$, of the first derivative of the force data at time point t. A sign function in accordance with Equations 3 and 4 is applied to the smoothed estimate, $d_t$, so as to obtain a first sign output. A (2p+1) point moving average filter is applied to the first sign output, $s_t$, to obtain a filtered first sign output. A sign function is applied to the filtered first sign output so as to obtain a second sign output. These operations are in accordance with Equations 4 and 5.

The second sign output includes a sequence of signed differences $\{\tilde{s}_t\}$ made up of subsequences $S_1, \ldots, S_N$ each containing coincident values. That is subsequences containing all +1 values, or all −1 values, or all 0 values.

Only the two or three most recent subsequences $S_{N-2}$, $S_{N-1}$, $S_N$, or in most cases only the timings of these subsequences are required to be stored.

In one example, the final subsequence $S_N$ contains all −1 values and terminates when the upper appendage of the athlete lifts from the surface. In effect, the end of the final subsequence $S_N$ identifies the moment where the upper appendage of the athlete lifts from the surface. That is, the end of the final subsequence $S_N$ identifies the third transition point 403 (FIG. 5). The start of the final subsequence $S_N$ identifies the moment of maximum force exerted by the upper appendage on the surface. That is, the start of the final subsequence $S_N$ identifies the second transition point 402 (FIG. 5). The penultimate subsequence $S_{N-1}$ contains all +1 values, That is, the end of the penultimate subsequence $S_{N-1}$ identifies the moment of maximum force exerted by the upper appendage on the surface, i.e. second transition point 402. The start of the penultimate subsequence $S_{N-1}$ identifies the moment the moment the at least one upper appendage of the athlete begins the starting action. That is, the start of the penultimate subsequence $S_{N-1}$ identifies the first transition point 401 (FIG. 5).

In another example, the final subsequence $S_N$ contains all +1 values and ends at the point when the at least one appendage exerts the maximum force on the surface during the starting action. That is, the end of the final subsequence $S_N$ identifies the second transition point 402 (FIG. 5). The start of the final subsequence $S_N$ identifies the moment the at least one upper appendage of the athlete begins the starting action. That is, the start of the final subsequence $S_N$ identifies the first transition point 401 (FIG. 5).

In step 703, the athlete start time is compared to the event start time to determine whether a false start has occurred. This involves determining whether the athlete start time is less than a predetermined threshold after the event start time. If so, it is determined that a false start has occurred.

Figure 8:
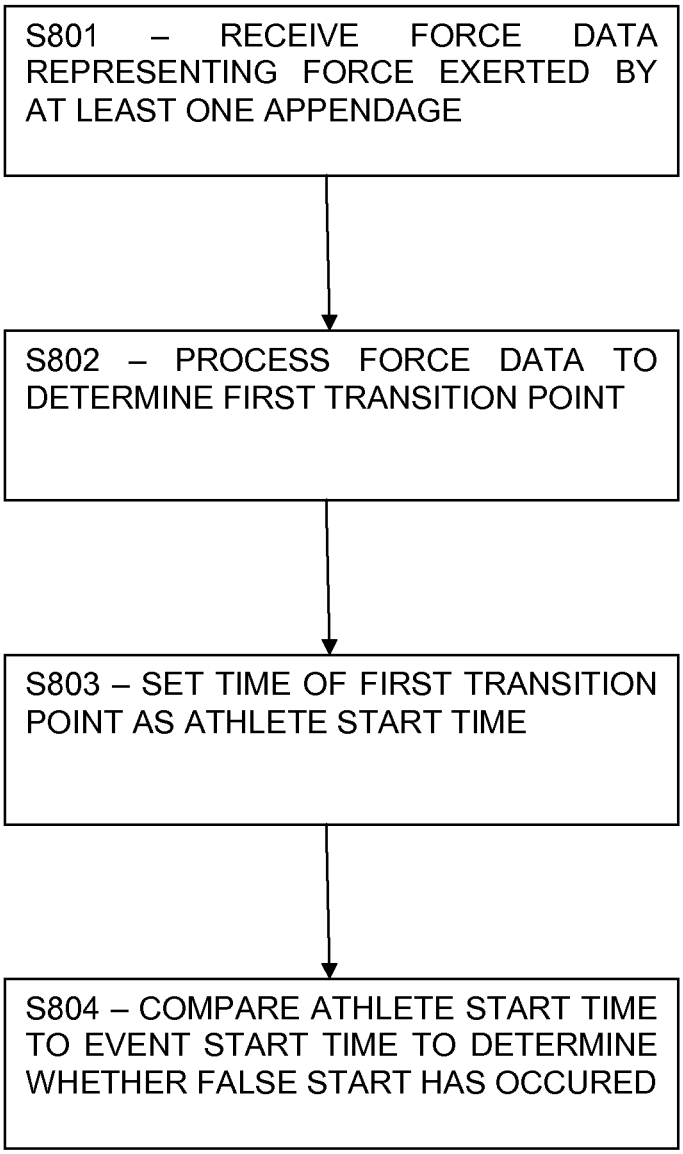
FIG. 8 shows a flow diagram for a method according to the fifth aspect.

Referring to FIG. 8, there is shown a flow diagram of a method according to the fifth aspect.

In Step 801, force data is received from a force sensor. The force data represents the force exerted by at least one appendage of the athlete on a surface when in a starting position.

In Step 802, the force data is processed to identify a first transition point representing the moment that the at least one appendage of the athlete begins a starting action. The processing of the force data may be performed in the same way as in Step 702 (FIG. 7) of the method according to the first aspect.

In Step 803, the time at which the first transition point occurs is set as an athlete start time for the event.

In Step 804, the athlete start time is compared to the event start time to determine whether a false start has occurred.

In one example of the method according to the fifth aspect, the at least one appendage is a lower appendage of the athlete. In this example, the force sensor is attached to or integrated into the starting block 3 (FIG. 1).

It will be appreciated that numerous modifications to the above described embodiments may be made without departing from the scope of the invention as defined in the appended claims. For example, the above examples have focused on athlete events involving a running track, such as track athletics and especially foot races. The present invention is, however, not limited to this particular application and instead can be used in other events as appropriately selected by the skilled person in the art. For example, the present invention may be used in swimming events. In swimming events, the athlete's starting position is with the at least one upper appendage of the athlete resting on a starting block. From this starting position, the athlete will dive or propel themselves into the water so as to start the swimming race. The force data in this instance represents the force exerted by the at least one upper appendage on the starting block.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

Various combinations of optional features have been described herein, and it will be appreciated that described features may be combined in any suitable combination. In particular, the features of any one example embodiment may be combined with features of any other embodiment, as appropriate, except where such combinations are mutually exclusive. Throughout this specification, the term "comprising" or "comprises" means including the component(s) specified but not to the exclusion of the presence of others.

In summary, there is provided a method, a false start detection system, and a false start detection sensor for determining whether an athlete has performed a false start in an event. Force data is received representing the force exerted by at least one upper appendage of the athlete on a surface when in a starting position (S701). The force data is processed to determine an athlete start time (S702), and the athlete start time is compared to an event start time to determine whether a false start has occurred (S703).

Although a few preferred embodiments of the present invention have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method of determining whether an athlete has performed a false start in a sprint event on a running track, the method performed by a processor executing instructions stored in a computer readable medium and comprising:

receiving, from a load cell in the running track, force data representing the force exerted by at least one upper appendage of the athlete on a surface in physical contact with the load cell when in a starting position of the sprint event;

processing the force data to determine an athlete start time for the event by identifying first and second transition points indicating a change in the gradient of the force data, the first transition point indicating the occurrence of a starting action of the at least one upper appendage of the athlete from a change in the force exerted by the at least one upper appendage on the surface, comprising:

identifying the second transition point representing a moment of maximum force exerted by the at least one upper appendage of the athlete on the surface;

identifying a transition point preceding the second transition point as the first transition point; and setting the athlete start time to the first transition point; and comparing the athlete start time to an event start time to determine whether a false start has occurred.

2. A method as claimed in claim 1, wherein comparing the athlete start time and the event start time comprises determining whether the athlete start time is less than a predetermined threshold after the event start time, and, if so, determining that a false start has occurred.

3. A computer readable medium having instructions recorded thereon which, when executed by a processor, cause the processor to perform a method as claimed in claim 1.

4. A false start detection system for determining whether an athlete has performed a false start in a sprint event on a running track, the system comprising:

a load cell in the running track, configured to measure the force exerted by the at least one upper appendage of the athlete on a surface in physical contact with the load cell when in a starting position;

a processing module executing instructions stored in a computer readable medium, the processing module receiving force data from the force sensor and processing the force data to determine an athlete start time for the event by identifying first and second transition points indicating a change in the gradient of the force data, the first transition point indicating the occurrence of a starting action of the at least one upper appendage of the athlete from a change in the force exerted by the at least one upper appendage on the surface, the instructions causing the processing module to:

identify the second transition point representing a moment of maximum force exerted by the at least one upper appendage of the athlete on the surface;

identify a transition point preceding the second transition point as the first transition point; and set the athlete start time to the first transition point; and a comparison module configured to compare the athlete start time to an event start time representing the start of the event to determine whether a false start has occurred.

5. A false start detection system as claimed in claim 4, wherein the load cell forms part of or is disposed in the vicinity of the surface.

6. A false start detection system as claimed in claim 4, wherein the surface is a running surface, and wherein load cell is integrated into the running surface.

7. A false start detection system as claimed in claim 4, wherein the surface is a running surface, and wherein the load cell comprises one or more attachment members for attaching the load cell to the running surface.

* * * * *